US008240875B2

(12) United States Patent
Roberts et al.

(10) Patent No.: US 8,240,875 B2
(45) Date of Patent: Aug. 14, 2012

(54) SOLID STATE LINEAR ARRAY MODULES FOR GENERAL ILLUMINATION

(75) Inventors: John Roberts, Grand Rapids, MI (US); Robert Chaloupecky, Apex, NC (US); Chenhua You, Cary, NC (US)

(73) Assignee: Cree, Inc., Durham, NC (US)

( * ) Notice: Subject to any disclaimer, the term of this patent is extended or adjusted under 35 U.S.C. 154(b) by 565 days.

(21) Appl. No.: 12/146,018

(22) Filed: Jun. 25, 2008

(65) Prior Publication Data

US 2009/0323334 A1 Dec. 31, 2009

(51) Int. Cl.
*F21V 7/00* (2006.01)

(52) U.S. Cl. ..... 362/217.05; 362/231

(58) Field of Classification Search ..... 362/311.01–311.02, 249.11, 249.02, 362/242–248, 235, 231, 232, 326, 612–613, 362/616, 217.01–217.02, 217.04–217.05, 362/217.1, 227, 218

See application file for complete search history.

(56) References Cited

U.S. PATENT DOCUMENTS

| | | | | |
|---|---|---|---|---|
| 1,494,461 | A * | 5/1924 | Collins | 362/499 |
| 2,295,339 | A | 9/1942 | Ericson | |
| 2,907,870 | A | 10/1959 | Calmes | |
| 3,805,937 | A | 4/1974 | Hatanaka et al. | |
| 3,875,456 | A | 4/1975 | Kano et al. | |
| 3,927,290 | A | 12/1975 | Denley | |
| 4,120,026 | A | 10/1978 | Tsuchihashi et al. | |
| 4,325,146 | A | 4/1982 | Lennington | |
| 4,408,157 | A | 10/1983 | Beaubien | |
| 4,420,398 | A | 12/1983 | Castino | |
| 4,710,699 | A | 12/1987 | Miyamoto | |
| 4,733,335 | A | 3/1988 | Serizawa et al. | |
| 4,918,497 | A | 4/1990 | Edmond | |
| 4,935,665 | A | 6/1990 | Murata | |
| 4,946,547 | A | 8/1990 | Palmour et al. | |

(Continued)

FOREIGN PATENT DOCUMENTS

EP 1 081 771 A2 3/2001

(Continued)

OTHER PUBLICATIONS

U.S. Appl. No. 12/146,018, filed Jun. 27, 2008, Roberts.

(Continued)

*Primary Examiner* — Julie Shallenberger
(74) *Attorney, Agent, or Firm* — Myers Bigel Sibley & Sajovec

(57) ABSTRACT

An illumination module includes a longitudinal support member including a base portion and a pair of sidewalls extending from the base portion that together define a channel that extends in a longitudinal direction. A printed circuit board (PCB) on the base portion extends in the longitudinal direction within the channel. A plurality of light emitting diodes (LEDs) are on the PCB in a linear array. A reflective sheet is within and extends across the channel, and includes a plurality of holes that correspond with locations of the LEDs on the PCB, and the LEDs are at least partially within the holes. An optical film extends across the channel above the reflective sheet and defines an optical cavity between the reflective sheet and the optical film. The optical film, the reflective sheet and the sidewalls of the support member are configured to recycle light in the optical cavity by reflecting some light emitted by the LEDs back into the optical cavity and transmitting some light emitted by the LEDs out of the optical cavity.

14 Claims, 7 Drawing Sheets

U.S. PATENT DOCUMENTS

| | | | | |
|---|---|---|---|---|
| 4,966,862 | A | 10/1990 | Edmond | |
| 5,027,168 | A | 6/1991 | Edmond | |
| 5,087,883 | A | 2/1992 | Hoffman | |
| 5,111,606 | A | 5/1992 | Reynolds | |
| 5,200,022 | A | 4/1993 | Kong et al. | |
| 5,210,051 | A | 5/1993 | Carter, Jr. | |
| 5,264,997 | A | 11/1993 | Hutchisson et al. | |
| 5,277,840 | A | 1/1994 | Osaka et al. | |
| 5,338,944 | A | 8/1994 | Edmond et al. | |
| 5,393,993 | A | 2/1995 | Edmond et al. | |
| 5,407,799 | A | 4/1995 | Studier | |
| 5,410,519 | A | 4/1995 | Hall et al. | |
| 5,416,342 | A | 5/1995 | Edmond et al. | |
| 5,477,436 | A | 12/1995 | Bertling et al. | |
| 5,523,589 | A | 6/1996 | Edmond et al. | |
| 5,563,849 | A | 10/1996 | Hall et al. | |
| 5,580,153 | A * | 12/1996 | Motz | 362/496 |
| 5,604,135 | A | 2/1997 | Edmond et al. | |
| 5,614,131 | A | 3/1997 | Mukerji et al. | |
| 5,631,190 | A | 5/1997 | Negley | |
| 5,739,554 | A | 4/1998 | Edmond et al. | |
| 5,766,987 | A | 6/1998 | Mitchell et al. | |
| 5,803,579 | A | 9/1998 | Turnbull et al. | |
| 5,813,753 | A | 9/1998 | Vriens | |
| 5,820,253 | A | 10/1998 | Scholz | |
| 5,851,063 | A | 12/1998 | Doughty et al. | |
| 5,858,278 | A | 1/1999 | Itoh et al. | |
| 5,890,794 | A | 4/1999 | Abtahi et al. | |
| 5,912,477 | A | 6/1999 | Negley | |
| 5,923,053 | A | 7/1999 | Jakowetz et al. | |
| 5,924,785 | A | 7/1999 | Zhang et al. | |
| 5,959,316 | A | 9/1999 | Lowery | |
| 5,962,971 | A | 10/1999 | Chen | |
| 5,998,925 | A | 12/1999 | Shimizu et al. | |
| 6,001,671 | A | 12/1999 | Fjelstad | |
| 6,066,861 | A | 5/2000 | Hohn et al. | |
| 6,069,440 | A | 5/2000 | Shimizu et al. | |
| 6,076,936 | A | 6/2000 | George | |
| 6,082,870 | A | 7/2000 | George | |
| 6,084,250 | A | 7/2000 | Justel et al. | |
| 6,087,202 | A | 7/2000 | Exposito et al. | |
| 6,095,666 | A | 8/2000 | Salam | |
| 6,120,600 | A | 9/2000 | Edmond et al. | |
| 6,132,072 | A | 10/2000 | Turnbull et al. | |
| 6,139,304 | A | 10/2000 | Centofante | |
| 6,153,448 | A | 11/2000 | Takahashi | |
| 6,163,038 | A | 12/2000 | Chen et al. | |
| 6,170,963 | B1 * | 1/2001 | Arnold | 362/246 |
| 6,187,606 | B1 | 2/2001 | Edmond et al. | |
| 6,201,262 | B1 | 3/2001 | Edmond et al. | |
| 6,212,213 | B1 | 4/2001 | Weber et al. | |
| 6,224,728 | B1 | 5/2001 | Oborny et al. | |
| 6,234,648 | B1 | 5/2001 | Borner et al. | |
| 6,245,259 | B1 | 6/2001 | Hohn et al. | |
| 6,252,254 | B1 | 6/2001 | Soules et al. | |
| 6,255,670 | B1 | 7/2001 | Srivastava et al. | |
| 6,278,135 | B1 | 8/2001 | Srivastava et al. | |
| 6,278,607 | B1 | 8/2001 | Moore et al. | |
| 6,292,901 | B1 | 9/2001 | Lys et al. | |
| 6,294,800 | B1 | 9/2001 | Duggal et al. | |
| 6,319,425 | B1 | 11/2001 | Tasaki et al. | |
| 6,329,224 | B1 | 12/2001 | Nguyen et al. | |
| 6,331,063 | B1 | 12/2001 | Kamada et al. | |
| 6,335,538 | B1 | 1/2002 | Prutchi et al. | |
| 6,337,536 | B1 | 1/2002 | Matsubara et al. | |
| 6,338,813 | B1 | 1/2002 | Hsu et al. | |
| 6,348,766 | B1 | 2/2002 | Ohishi | |
| 6,350,041 | B1 | 2/2002 | Tarsa et al. | |
| 6,357,889 | B1 | 3/2002 | Duggal et al. | |
| 6,361,186 | B1 * | 3/2002 | Slayden | 362/241 |
| 6,376,277 | B2 | 4/2002 | Corises | |
| 6,394,621 | B1 | 5/2002 | Hanewinkel, III | |
| 6,396,081 | B1 | 5/2002 | Tews et al. | |
| 6,404,125 | B1 | 6/2002 | Garbuzov et al. | |
| 6,416,200 | B1 | 7/2002 | George | |
| 6,429,583 | B1 | 8/2002 | Levinson et al. | |
| 6,441,558 | B1 | 8/2002 | Muthu et al. | |
| 6,441,943 | B1 | 8/2002 | Roberts et al. | |
| 6,469,322 | B1 | 10/2002 | Srivastava et al. | |
| 6,480,299 | B1 | 11/2002 | Drakopoulos et al. | |
| 6,482,520 | B1 | 11/2002 | Tzeng | |
| 6,501,100 | B1 | 12/2002 | Srivastava et al. | |
| 6,501,102 | B2 | 12/2002 | Mueller-Mach et al. | |
| 6,504,179 | B1 | 1/2003 | Ellens et al. | |
| 6,504,301 | B1 | 1/2003 | Lowery | |
| 6,509,651 | B1 | 1/2003 | Matsubara et al. | |
| 6,513,949 | B1 | 2/2003 | Marshall et al. | |
| 6,522,065 | B1 | 2/2003 | Srivastava et al. | |
| 6,531,328 | B1 | 3/2003 | Chen | |
| 6,538,371 | B1 | 3/2003 | Duggal et al. | |
| 6,550,949 | B1 | 4/2003 | Bauer et al. | |
| 6,552,495 | B1 | 4/2003 | Chang | |
| 6,576,930 | B2 | 6/2003 | Reech et al. | |
| 6,577,073 | B2 | 6/2003 | Shimizu et al. | |
| 6,578,986 | B2 | 6/2003 | Swaris et al. | |
| 6,578,998 | B2 | 6/2003 | Zhang | |
| 6,583,444 | B2 | 6/2003 | Fjelstad | |
| 6,592,810 | B2 | 7/2003 | Nishida et al. | |
| 6,600,175 | B1 | 7/2003 | Baretz et al. | |
| 6,600,324 | B2 | 7/2003 | St. Germain | |
| 6,603,258 | B1 | 8/2003 | Mueller-Mach et al. | |
| 6,608,332 | B2 | 8/2003 | Shimizu et al. | |
| 6,608,485 | B2 | 8/2003 | St. Germain | |
| 6,614,197 | B2 | 9/2003 | Berringer | |
| 6,616,862 | B2 | 9/2003 | Srivastava et al. | |
| 6,624,058 | B1 | 9/2003 | Kazama | |
| 6,624,350 | B2 | 9/2003 | Nixon et al. | |
| 6,642,618 | B2 | 11/2003 | Yagi et al. | |
| 6,642,652 | B2 | 11/2003 | Collins, III et al. | |
| 6,642,666 | B1 | 11/2003 | St. Germain | |
| 6,653,765 | B1 | 11/2003 | Levinson | |
| 6,659,623 | B2 * | 12/2003 | Friend | 362/249.06 |
| 6,659,632 | B2 | 12/2003 | Chen | |
| 6,685,852 | B2 | 2/2004 | Setlur et al. | |
| 6,686,691 | B1 | 2/2004 | Mueller et al. | |
| 6,692,136 | B2 | 2/2004 | Marshall et al. | |
| 6,703,173 | B2 | 3/2004 | Lu et al. | |
| 6,712,486 | B1 | 3/2004 | Popovich et al. | |
| 6,733,711 | B2 | 5/2004 | Durocher et al. | |
| 6,734,571 | B2 | 5/2004 | Bolken | |
| 6,737,801 | B2 | 5/2004 | Ragle | |
| 6,740,972 | B2 | 5/2004 | Smith et al. | |
| 6,744,194 | B2 | 6/2004 | Fukasawa et al. | |
| 6,759,266 | B1 | 7/2004 | Hoffman | |
| 6,762,563 | B2 | 7/2004 | St. Germain et al. | |
| 6,784,463 | B2 | 8/2004 | Camras et al. | |
| 6,791,119 | B2 | 9/2004 | Slater, Jr. et al. | |
| 6,791,257 | B1 | 9/2004 | Sato et al. | |
| 6,793,371 | B2 | 9/2004 | Lamke et al. | |
| 6,799,865 | B2 | 10/2004 | Ellens et al. | |
| 6,800,932 | B2 | 10/2004 | Lam et al. | |
| 6,805,474 | B2 | 10/2004 | Walser et al. | |
| 6,812,500 | B2 | 11/2004 | Reech et al. | |
| 6,817,735 | B2 | 11/2004 | Shimizu et al. | |
| 6,841,804 | B1 | 1/2005 | Chen et al. | |
| 6,846,093 | B2 | 1/2005 | Swaris et al. | |
| 6,851,834 | B2 | 2/2005 | Leysath | |
| 6,853,010 | B2 | 2/2005 | Slater, Jr. et al. | |
| 6,857,767 | B2 | 2/2005 | Matsui et al. | |
| 6,860,621 | B2 | 3/2005 | Bachl et al. | |
| 6,864,573 | B2 | 3/2005 | Robertson et al. | |
| 6,871,982 | B2 | 3/2005 | Holman et al. | |
| 6,880,954 | B2 | 4/2005 | Ollett et al. | |
| 6,882,101 | B2 | 4/2005 | Ragle | |
| 6,911,667 | B2 | 6/2005 | Pichler et al. | |
| 6,914,267 | B2 | 7/2005 | Fukasawa et al. | |
| 6,919,683 | B1 | 7/2005 | Jang | |
| 6,936,857 | B2 | 8/2005 | Doxsee et al. | |
| 6,949,772 | B2 | 9/2005 | Shimizu et al. | |
| 6,958,497 | B2 | 10/2005 | Emerson et al. | |
| 6,964,507 | B2 | 11/2005 | Mohacsi | |
| 6,967,116 | B2 | 11/2005 | Negley | |
| 6,985,163 | B2 | 1/2006 | Riddle et al. | |
| 6,995,355 | B2 | 2/2006 | Rains, Jr. et al. | |
| 7,001,047 | B2 | 2/2006 | Holder et al. | |
| 7,005,679 | B2 | 2/2006 | Tarsa et al. | |
| 7,008,078 | B2 | 3/2006 | Shimizu et al. | |

7,009,343 B2 3/2006 Lim et al.
7,014,336 B1 3/2006 Ducharme et al.
7,023,019 B2 4/2006 Maeda et al.
7,029,935 B2 4/2006 Negley et al.
7,030,486 B1 4/2006 Marshall
7,049,159 B2 5/2006 Lowery
7,061,454 B2 6/2006 Sasuga et al.
7,066,623 B2 6/2006 Lee et al.
7,083,302 B2 8/2006 Chen et al.
7,093,958 B2 8/2006 Coushaine
7,095,056 B2 8/2006 Vitta et al.
7,095,110 B2 8/2006 Arik et al.
7,102,172 B2 9/2006 Lynch et al.
7,108,396 B2 9/2006 Swaris et al.
7,114,831 B2 10/2006 Popovich et al.
7,121,688 B2 10/2006 Rempel
7,121,925 B2 10/2006 Hashimura et al.
7,125,143 B2 10/2006 Hacker
7,131,760 B2 11/2006 Mayer et al.
7,135,664 B2 11/2006 Vornsand et al.
7,144,140 B2 12/2006 Sun et al.
7,148,470 B2 12/2006 Rains, Jr. et al.
7,164,231 B2 1/2007 Choi et al.
7,178,941 B2 2/2007 Roberge et al.
7,183,587 B2 2/2007 Negley et al.
7,188,956 B2 3/2007 Otsuka et al.
7,190,387 B2 3/2007 Rinehart et al.
7,195,944 B2 3/2007 Tran et al.
7,200,009 B2 4/2007 Narhi et al.
7,202,598 B2 4/2007 Juestel et al.
7,207,691 B2 4/2007 Lee et al.
7,210,817 B2 5/2007 Lee et al.
7,210,832 B2 5/2007 Huang
7,213,940 B1 * 5/2007 Van De Ven et al. ..... 362/231
7,215,074 B2 5/2007 Shimizu et al.
7,226,189 B2 6/2007 Lee et al.
7,232,212 B2 6/2007 Iwase
7,234,844 B2 6/2007 Bolta et al.
7,239,085 B2 7/2007 Kawamura
7,244,058 B2 7/2007 DiPenti et al.
7,246,921 B2 7/2007 Jacobson et al.
7,250,715 B2 7/2007 Mueller et al.
7,251,079 B2 7/2007 Capaldo et al.
7,255,457 B2 8/2007 Ducharme et al.
7,256,557 B2 8/2007 Lim et al.
7,258,475 B2 8/2007 Kurumatani
7,262,912 B2 8/2007 Wood
7,264,378 B2 9/2007 Loh et al.
7,276,861 B1 10/2007 Shteynberg et al.
7,278,760 B2 10/2007 Heuser et al.
7,286,296 B2 10/2007 Chaves et al.
7,294,816 B2 11/2007 Ng et al.
7,303,288 B2 12/2007 Miyazawa et al.
7,306,353 B2 12/2007 Popovich et al.
7,324,276 B2 1/2008 Wood
7,329,024 B2 2/2008 Lynch et al.
7,344,952 B2 3/2008 Chandra
7,350,955 B2 4/2008 Chang et al.
7,354,180 B2 4/2008 Sawhney et al.
7,355,284 B2 4/2008 Negley
7,358,954 B2 4/2008 Negley et al.
7,365,485 B2 4/2008 Fukasawa et al.
7,365,991 B2 4/2008 Aldrich et al.
7,374,306 B2 5/2008 Liu
7,374,311 B2 5/2008 Rains, Jr. et al.
7,387,405 B2 6/2008 Ducharme et al.
7,387,406 B2 6/2008 Swaris et al.
7,402,940 B2 7/2008 Nakano et al.
7,414,637 B2 8/2008 Wood et al.
7,420,742 B2 9/2008 Wood et al.
7,422,504 B2 9/2008 Maeda et al.
7,453,195 B2 11/2008 Radkov
7,465,414 B2 12/2008 Knox et al.
7,473,934 B2 1/2009 Nagai et al.
7,474,044 B2 1/2009 Ge
7,502,169 B2 3/2009 Wood
7,524,089 B2 4/2009 Park
7,534,633 B2 5/2009 Batres et al.
7,554,129 B2 6/2009 Roth et al.
7,564,180 B2 7/2009 Brandes
7,566,160 B2 7/2009 Song et al.
7,582,911 B2 9/2009 Lynch et al.
7,594,740 B2 9/2009 Popovich et al.
7,622,803 B2 11/2009 Parker et al.
2002/0006040 A1 1/2002 Kamada et al.
2002/0087532 A1 7/2002 Barritz et al.
2003/0030063 A1 2/2003 Sosniak et al.
2003/0038596 A1 2/2003 Ho
2003/0063463 A1 * 4/2003 Sloan et al. ..... 362/238
2003/0066311 A1 4/2003 Li et al.
2003/0156425 A1 * 8/2003 Turnbull et al. ..... 362/545
2003/0222268 A1 12/2003 Yocom et al.
2004/0004435 A1 1/2004 Hsu
2004/0012958 A1 1/2004 Hashimoto et al.
2004/0037949 A1 2/2004 Wright
2004/0038442 A1 2/2004 Kinsman
2004/0046178 A1 3/2004 Sano
2004/0051111 A1 3/2004 Ota et al.
2004/0090174 A1 5/2004 Tasch et al.
2004/0105264 A1 6/2004 Spero
2004/0165379 A1 8/2004 Waters
2004/0218387 A1 11/2004 Gerlach
2004/0264193 A1 12/2004 Okumura
2005/0058948 A1 3/2005 Freese et al.
2005/0168689 A1 8/2005 Knox
2005/0243556 A1 11/2005 Lynch
2005/0251698 A1 11/2005 Lynch et al.
2005/0265404 A1 12/2005 Ashdown
2005/0280756 A1 12/2005 Kim et al.
2006/0001537 A1 1/2006 Blake et al.
2006/0012989 A1 1/2006 Lee
2006/0022582 A1 2/2006 Radkov
2006/0060872 A1 3/2006 Edmond et al.
2006/0061869 A1 3/2006 Fadel et al.
2006/0067073 A1 3/2006 Ting
2006/0098440 A1 5/2006 Allen
2006/0105482 A1 5/2006 Alferink et al.
2006/0113548 A1 6/2006 Chen et al.
2006/0138435 A1 6/2006 Tarsa et al.
2006/0138937 A1 6/2006 Ibbetson
2006/0181192 A1 8/2006 Radkov
2006/0221574 A1 * 10/2006 Song et al. ..... 361/704
2006/0245184 A1 11/2006 Galli
2006/0275714 A1 12/2006 Rinehart et al.
2006/0285332 A1 12/2006 Goon et al.
2007/0001188 A1 1/2007 Lee
2007/0003868 A1 1/2007 Wood et al.
2007/0008738 A1 1/2007 Han et al.
2007/0019419 A1 * 1/2007 Hafuka et al. ..... 362/373
2007/0041220 A1 2/2007 Lynch
2007/0047228 A1 * 3/2007 Thompson et al. ..... 362/237
2007/0051966 A1 3/2007 Higashi
2007/0058377 A1 * 3/2007 Zampini et al. ..... 362/372
2007/0090381 A1 4/2007 Otsuka et al.
2007/0121343 A1 * 5/2007 Brown ..... 362/612
2007/0137074 A1 6/2007 Van De Ven et al.
2007/0139920 A1 6/2007 Van De Ven et al.
2007/0139923 A1 6/2007 Negley et al.
2007/0170447 A1 7/2007 Negley et al.
2007/0171145 A1 7/2007 Coleman et al.
2007/0188425 A1 8/2007 Saccomanno
2007/0202623 A1 8/2007 Gao
2007/0216704 A1 9/2007 Roberts et al.
2007/0223219 A1 9/2007 Medendorp, Jr. et al.
2007/0236911 A1 10/2007 Negley
2007/0247414 A1 10/2007 Roberts
2007/0247847 A1 10/2007 Villard
2007/0262337 A1 11/2007 Villard
2007/0263393 A1 11/2007 Van De Ven et al.
2007/0267983 A1 11/2007 Van De Ven et al.
2007/0274063 A1 11/2007 Negley
2007/0274080 A1 11/2007 Negley et al.
2007/0276606 A1 11/2007 Radkov
2007/0278503 A1 12/2007 Van De Ven et al.
2007/0278934 A1 12/2007 Van De Ven et al.
2007/0278974 A1 12/2007 Van De Ven et al.
2007/0279440 A1 12/2007 Negley
2007/0279903 A1 12/2007 Negley et al.

2007/0280624 A1 12/2007 Negley et al.
2007/0291473 A1* 12/2007 Traynor ..... 362/106
2008/0006815 A1 1/2008 Wang et al.
2008/0055915 A1 3/2008 Lynch et al.
2008/0084685 A1 4/2008 Van De Ven et al.
2008/0084700 A1 4/2008 Van De Ven
2008/0084701 A1 4/2008 Van De Ven et al.
2008/0088248 A1 4/2008 Myers
2008/0089053 A1 4/2008 Negley
2008/0089069 A1 4/2008 Medendorp
2008/0103714 A1 5/2008 Aldrich et al.
2008/0106895 A1 5/2008 Van De Ven et al.
2008/0106907 A1 5/2008 Trott et al.
2008/0112168 A1 5/2008 Pickard et al.
2008/0112170 A1 5/2008 Trott et al.
2008/0112183 A1 5/2008 Negley
2008/0130265 A1 6/2008 Negley et al.
2008/0130285 A1 6/2008 Negley et al.
2008/0136313 A1 6/2008 Van De Ven et al.
2008/0137347 A1 6/2008 Trott et al.
2008/0170396 A1 7/2008 Yuan et al.
2008/0179602 A1 7/2008 Negley et al.
2008/0192462 A1 8/2008 Steedly et al.
2008/0192493 A1 8/2008 Villard
2008/0211416 A1 9/2008 Negley et al.
2008/0224157 A1 9/2008 Slater
2008/0231201 A1 9/2008 Higley et al.
2008/0259589 A1 10/2008 Van De Ven
2008/0278928 A1 11/2008 Van De Ven et al.
2008/0278940 A1 11/2008 Van De Ven et al.
2008/0278950 A1 11/2008 Pickard et al.
2008/0278952 A1 11/2008 Trott et al.
2008/0304260 A1 12/2008 Van De Ven et al.
2008/0304261 A1 12/2008 Van De Ven et al.
2008/0304269 A1 12/2008 Pickard et al.
2008/0309255 A1 12/2008 Myers et al.
2008/0310154 A1 12/2008 Van De Ven et al.
2009/0002986 A1 1/2009 Medendorp, Jr. et al.

FOREIGN PATENT DOCUMENTS

EP 1 081 771 A3 3/2001
EP 1 111 966 A2 6/2001
EP 1 111 966 A3 6/2001
WO WO 98/43014 10/1998
WO WO 00/34709 6/2000

OTHER PUBLICATIONS

Narendran et al., "Solid-state lighting: failure analysis of white LEDs", Journal of Crystal Growth, vol. 268, Issues 3-4, Aug. 1, 2004, Abstract.

International Search Report and Written Opinion of the International Searching Authority for PCT application PCT/US2007/10766 dated Sep. 24, 2008.

International Search Report and Written Opinion of the International Searching Authority for PCT application PCT/US2006/48521 dated Feb. 7, 2008.

Supplementary European Search Report corresponding to European Application No. EP 06 84 5870 dated Nov. 6, 2008.

Cree LED Light, LR6, 6" Downlight Module, Product Description 2 pages.

* cited by examiner

SOLID STATE LINEAR ARRAY MODULES FOR GENERAL ILLUMINATION

FIELD OF THE INVENTION

The present invention relates to solid state lighting, and more particularly to solid state lighting systems for general illumination.

BACKGROUND

Solid state lighting arrays are used for a number of lighting applications. For example, solid state lighting panels including arrays of solid state lighting devices have been used as direct illumination sources, for example, in architectural and/or accent lighting. A solid state lighting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region.

Solid state lighting panels are commonly used as backlights for small liquid crystal display (LCD) display screens, such as LCD display screens used in portable electronic devices. In addition, there has been increased interest in the use of solid state lighting panels for general illumination, such as indoor lighting.

The color rendering index of a light source is an objective measure of the ability of the light generated by the source to accurately illuminate a broad range of colors. The color rendering index ranges from essentially zero for monochromatic sources to nearly 100 for incandescent sources. For large-scale backlight and illumination applications, it is often desirable to provide a lighting source that generates white light having a high color rendering index, so that objects illuminated by the lighting panel may appear more natural. Accordingly, such lighting sources may typically include an array of solid state lighting devices including red, green and blue light emitting devices. When red, green and blue light emitting devices are energized simultaneously, the resulting combined light may appear white, or nearly white, depending on the relative intensities of the red, green and blue sources. There are many different hues of light that may be considered "white." For example, some "white" light, such as light generated by sodium vapor lighting devices, may appear yellowish in color, while other "white" light, such as light generated by some fluorescent lighting devices, may appear more bluish in color.

The chromaticity of a particular light source may be referred to as the "color point" of the source. For a white light source, the chromaticity may be referred to as the "white point" of the source. The white point of a white light source may fall along a locus of chromaticity points corresponding to the color of light emitted by a black-body radiator heated to a given temperature. Accordingly, a white point may be identified by a correlated color temperature (CCT) of the light source, which is the temperature at which the heated black-body radiator matches the hue of the light source. White light typically has a CCT of between about 4000 and 8000K. White light with a CCT of 4000 has a yellowish color, while light with a CCT of 8000K is more bluish in color.

For larger illumination applications, multiple solid state lighting panels may be connected together, for example, in a one or two dimensional array, to form a lighting system.

Unfortunately, however, the hue of white light generated by the lighting system may vary from panel to panel, and/or even from lighting device to lighting device. Such variations may result from a number of factors, including variations of intensity of emission from different LEDs, and/or variations in placement of LEDs in a lighting device and/or on a panel. Accordingly, in order to construct a multi-panel lighting system that produces a consistent hue of white light from panel to panel, it may be desirable to measure the hue and saturation, or chromaticity, of light generated by a large number of panels, and to select a subset of panels having a relatively close chromaticity for use in the multi-panel lighting system. This may result in decreased yields and/or increased inventory costs for a manufacturing process.

Moreover, even if a solid state lighting panel has a consistent, desired hue of light when it is first manufactured, the hue and/or brightness of solid state devices within the panel may vary non-uniformly over time and/or as a result of temperature variations, which may cause the overall color point of a lighting panel made up of the panels to change over time and/or may result in non-uniformity of color across the lighting panel. In addition, a user may wish to change the light output characteristics of a lighting panel in order to provide a desired hue and/or brightness level of the lighting panel.

Solid state lighting sources may have a number of advantages over conventional lighting sources for general illumination. For example, a conventional incandescent spotlight may include a 150 watt lamp projecting light from a 30 square inch aperture. Thus, the source may dissipate about 5 watts of power per square inch. Such sources may have an efficiency of no more than about 10 lumens per watt, which means that in terms of ability to generate light in a given area, such a source may generate about 50 lumens per square inch in a relatively small space.

A conventional incandescent spotlight provides a relatively bright, highly directed source of light. However, an incandescent spotlight may illuminate only a small area. Thus, even though an incandescent spot light has a relatively high light output, it may not be suitable for general illumination, for example illumination of a room. Thus, when used indoors, spotlights are typically reserved for accent or fill-in lighting applications.

Fluorescent light bulbs, on the other hand, produce light in a manner that is more suitable for general illumination. Fluorescent light bulbs approximate line sources of light, for which the illuminance falls off in proportion to 1/r near the source, where r is the distance from the source. Furthermore, fluorescent light sources are typically grouped in a panel to approximate a plane source of light, which may be more useful for general interior illumination and/or other purposes, since the intensity of the light generated by a plane source may not drop off as quickly near the source as the intensity of a point or line source of light does.

The distributed nature of a fluorescent light panel and its suitability for interior illumination has made fluorescent light panels a popular choice for general lighting applications. As noted above, however, fluorescent light may appear slightly bluish. Furthermore, fluorescent light bulbs may present environmental difficulties, since they may include mercury as a component.

SUMMARY

An illumination module according to some embodiments includes a longitudinal support member including a base portion and a pair of sidewalls extending from the base portion, the base portion and the pair of sidewalls defining a channel that extends in a longitudinal direction. A printed circuit board (PCB) is on the base portion of the support member and extends in the longitudinal direction within the channel. A plurality of light emitting diodes (LEDs) are mounted on the PCB and arranged in an array extending in the longitudinal direction. A reflective sheet is within the channel and extends across the channel between the pair of sidewalls. The PCB is between the reflective sheet and the base portion of the support member. The reflective sheet may include a plurality of holes therein that are arranged to correspond with locations of the LEDs on the PCB, and the LEDs are at least partially positioned within the holes. An optical film is positioned in the channel above the reflective sheet and extends across the channel between the pair of sidewalls and defines an optical cavity between the reflective sheet and the optical film. The optical film, the reflective sheet and the sidewalls of the support member are configured to recycle light emitted by the LEDs by reflecting some light in the optical cavity back into the optical cavity and transmitting some light emitted by the LEDs out of the optical cavity.

The illumination module may further include a second optical film on the support member above the first optical film and extending between the pair of sidewalls. The second optical film and the first optical film define a second optical cavity. The first optical film, the second optical film and the sidewalls of the support member are configured to recycle light in the second optical cavity.

The first optical film may include a brightness enhancement film and the second optical film may include an optical diffuser. The reflective sheet may include a diffuse reflector.

The illumination module may further include a third optical film positioned in the first optical cavity between the first optical film and the reflective sheet and extending across the channel between the pair of sidewalls. The third optical film may include an optical diffuser.

The sidewalls may include a pair of longitudinally extending grooves within the channel. The optical film is engaged and supported within the channel by the grooves. The sidewalls may further include a plurality of outwardly extending fins on outer surfaces of the sidewalls.

The optical film may include a convex diffuser sheet that is bowed away from the channel. The reflective sheet may have a curved cross section in a lateral direction that is perpendicular to the longitudinal direction and the sidewalls may include a pair of longitudinal grooves therein that engage edges of the reflective sheet.

The illumination module may further include a second PCB on the base portion of the support member and extending in the longitudinal direction within the channel, so that the second PCB is adjacent to the first PCB in the longitudinal direction. The first PCB and the second PCB may each include an electrical connector at respective adjacent ends thereof. A wire jumper may connect the electrical connectors.

The plurality of light emitting diodes may include a metameric pair of LEDs. Chromaticities of the LEDs of the metameric pair are selected so that a combined light generated by a mixture of light from each of the LEDs of the metameric pair may include light having about a target chromaticity. Each of the LEDs of the metameric pair may have a luminosity that is approximately inversely proportional to a distance of a chromaticity of the LED to the target chromaticity in a two-dimensional chromaticity space.

In some embodiments, each of the LEDs has about the same luminosity and has a chromaticity that is about the same distance from the target chromaticity in the two-dimensional chromaticity space. The two-dimensional chromaticity space may include a 1931 CIE chromaticity space or a 1976 CIE chromaticity space.

The chromaticity of each of the LEDs is within about a seven step Macadam ellipse about a point on a blackbody radiation curve on a 1931 CIE chromaticity space from a correlated color temperature of 2500K to 8000K.

A subassembly for an illumination module including a support member having a base portion defining a channel that extends in a longitudinal direction includes a printed circuit board (PCB) on the base portion of the support member and extending in the longitudinal direction within the channel, and a plurality of light emitting diodes (LEDs) on the PCB and arranged in an array extending in the longitudinal direction. The plurality of light emitting diodes may include a metameric grouping of LEDs, and chromaticities of the LEDs of the metameric grouping are selected so that a combined light generated by a mixture of light from each of the LEDs of the metameric grouping may include light having about a target chromaticity.

A solid state luminaire according to some embodiments includes a troffer including a base portion and sidewall portions. A plurality of longitudinal illumination modules are provided on the base portion of the troffer.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION

Figure 1:
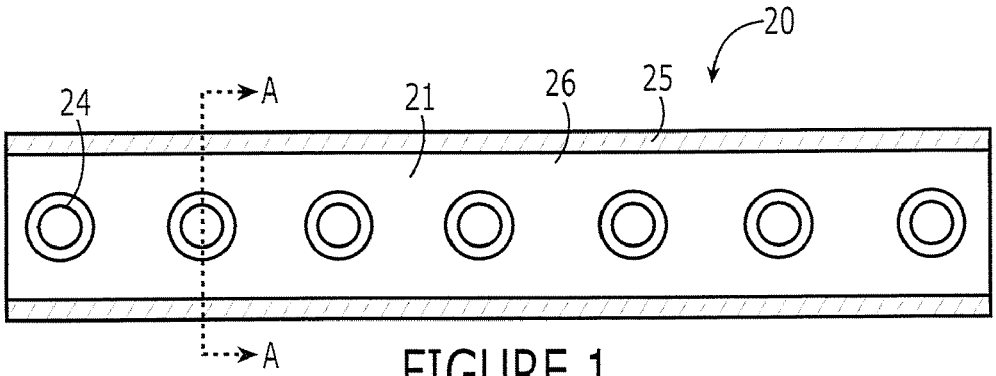
FIG. 1 is a plan view of a linear illumination module according to some embodiments.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "front" or "back" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this disclosure and the relevant art and will not be interpreted in an idealized or overly formal sense unless expressly so defined herein.

Some embodiments provide a linear illumination module that can achieve high uniformity. FIG. 1 is a plan view of a linear illumination module 20 according to some embodiments, and FIG. 2 is a cross-sectional view of the linear illumination module 20 along line A-A of FIG. 1.

A linear illumination module 20 according to some embodiments includes multiple surface mount technology (SMT) packaged LEDs 24 arranged in an array, such as a linear array, on a printed circuit board (PCB) 22, such as a metal core PCB (MCPCB), a standard FR-4 PCB, or a flex PCB. The LEDs 24 may include, for example, XLamp® brand packaged LEDs available from Cree, Inc., Durham, N.C. The array can also include a two-dimensional array of LEDs 24. The PCB 22 may optionally be bonded by an adhesive 19, such as double-sided PSA tape from Adhesives Research, for structural purposes and/or to provide improved thermal transfer to an underlying support member 21.

Figure 2:
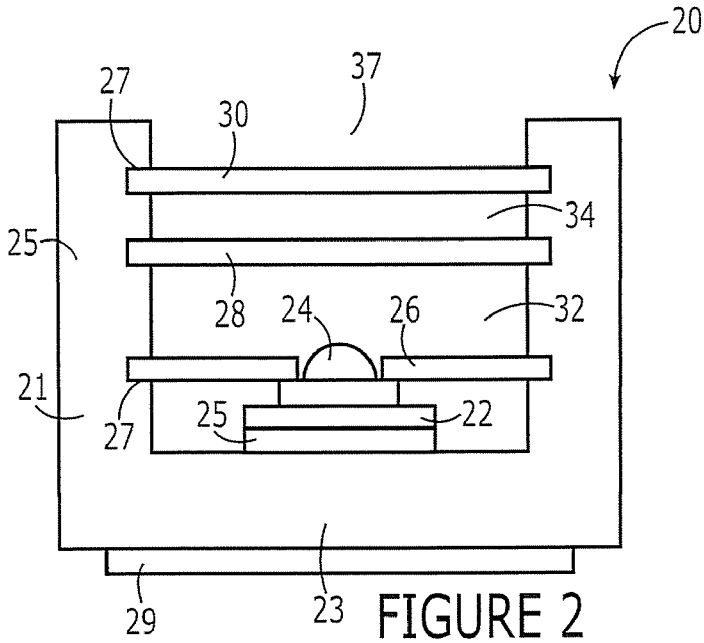
FIG. 2 is a cross-sectional view of the linear illumination module of FIG. 1.

As shown in FIGS. 1 and 2, the support member 21 may be a generally U-shaped metal channel, with or without additional grooves, such as an aluminum extrusion. The support member 21 may include a base portion 23 to which the PCB 22 is bonded and upwardly extending sidewalls 25 that form the generally U-shaped cross-section. The support member 21 may have supplemental holes (not shown) for registry and/or fastening the PCB 22. Such holes may be used to receive alignment pins to guide placement of the PCB 22 on the support member 21 during assembly. The support member 21 may be long enough to support multiple PCBs 22 placed end to end within the channel, and may include holes for registering the PCBs 22 in a precise fashion relative to one another. The LEDs 24 on each PCB 22 may be disposed in a regular linear array with, for example, 15 LEDs per one-foot section in some embodiments. When multiple PCBs 22 are provided upon one support member 21, the registration may be such that the regular linear array of one PCB 22 is a continuation of the regular linear array of the neighboring PCB 22. That is, in some embodiments, LEDs 24 at the respective ends of neighboring PCBs 22 may be positioned at the same distance from one another as LEDs 24 on the same PCB 22.

The base surface 23 of the support member 21, beneath the PCB, may be include an adhesive such as a double-sided PSA tape 29 to improve mechanical retention and thermal transfer to a surface it may be mounted upon.

The LEDs 24 on the PCB 22 can be wired using PCB traces 41 (See FIG. 4) in series, parallel or a combination of both. Other passive or active electronic components may be additionally mounted on the PCB 22 and connected to serve a particular function. Such components can include resistors, diodes, capacitors, transistors, thermal sensors, optical sensors, amplifiers, microprocessors, drivers, digital communication devices, RF or IR receivers or transmitters or other components, for example.

A reflective sheet 26 such as a microcellular polyethylene terephthalate (MCPET) or other white polymer sheet may be positioned over the PCB 22, with holes 26A cut and positioned so as to register the sheet 26 around the LEDs 24 and rest substantially level with, or beneath, the top most plane of the LEDs 24, but above the PCB 22. The reflective sheet 26 may be flat, as illustrated in FIG. 1, and/or may be bent or bowed in a parabolic, circular, hyperbolic, V-shape, U-shape or other form. Auxiliary grooves 27 in the support member 21 may be employed to retain the reflective sheet 26. Pushpins, screws or other fasteners may also or alternatively be pressed through holes in the reflective sheet 26 to hold it to the PCB 22 and/or the support member 21. The reflective sheet 26 may be a highly reflective material, and may include a highly diffuse material, such as MCPET, or a highly specular material, such as an Enhanced Specular Reflector (ESR) available from 3M Corporation, for example.

The support member 21 may have an extended linear or rectangular opening 37 opposite the base portion 23, the optional adhesive tape 25 and the optional reflector sheet 26. The channel defined by the support member 21 may be about as wide in the aforementioned opening 37 as it is deep. That is, the width of the base portion 23 of the support member 21 from sidewall to sidewall may be about the same as the height of the sidewall portions 25 of the support member 21. These proportions may vary up to 3:1 or more in either direction (depth/width or width/depth) to achieve various optical effects.

The opening 37 may be covered by one or more optical sheets 28, 30 that are substantially transparent but not wholly so. The optical sheets 28, 30 may include a simple transmissive diffuser, a surface embossed holographic diffuser, a brightness enhancing film (BEF), a Fresnel lens, TIR or other grooved sheet, a dual BEF (DBEF) or other polarizing film, a micro-lens array sheet, or other optical sheet. A first film 28 may be a BEF and a second film 30 may be a flat white diffuser. In some embodiments, the BEF 28 may be disposed in a flat configuration nearest the LEDs 24 and the optional reflector sheet 26. The BEF 28 may be engaged in and supported by auxiliary slots or grooves 27 in the support member 21. The second film 30 may be a flat or bowed diffuser sheet, disposed further away from the LEDs 24 than the BEF 28 and also may be engaged in and supported by auxiliary grooves or slots 27 in the support member 21. Accordingly, the BEF 28 defines a first optical cavity 32 within which the LEDs 24 are positioned (between the LEDs 24 and the BEF 28). In some embodiments, the first optical cavity 32 can be defined by the reflective sheet 26, the BEF 28 and the sidewalls 25 of the support member. A second optical cavity 34 is defined between the BEF 28 and the diffuser sheet 30.

The inner surfaces of sidewalls 25 may be painted, coated or otherwise covered with a diffuse or specular reflective material or layer, with a high reflectance.

Some light rays emitted by the LEDs 24 may be transmitted by the BEF 28 into the second optical cavity 34. Other light rays from the LEDs 24 may be reflected by the BEF 28 back into the first optical cavity 32, where they can be further mixed/recycled for later extraction.

Reflected rays may impinge the reflective sheet 26 and scatter. Some portion of scattered rays from the reflective sheet 26 may travel second or multiple times back to the BEF 28 and eventually transmit therethrough. Transmitted light may go through the outer diffuser sheet 30 (if present) and be scattered again, but also transmitted externally. In some embodiments, an extra diffuser sheet 39 (FIG. 3) may be placed between the LEDs 24 and the BEF 28. The recycling between the BEF 28 and the transmissive diffuser sheet 39 on one hand and the LEDs 24 and the reflective sheet 26 on the other hand may serve to further integrate or mix the light from multiple LEDs 24. This can greatly increase apparent uniformity of the linear LED array 20, in terms of chromaticity, luminosity and/or spectral power distribution.

In some embodiments, the linear structure of the BEF film 28 employed is oriented perpendicular to the large axis of the linear array 20 to facilitate mixing of the light. In embodiments with particularly good recycling and mixing, alternating LEDs may be disposed having measurably or substantially different luminosity (intensity, flux), chromaticity, color temperature, color rendering index (CRI), spectral power distribution, or a combination thereof. This may be advantageous, for example, to increase overall color rendering index of the module 20 or to more completely utilize available distributions of the LEDs 24, without appreciably or unacceptably compromising apparent uniformity from module 20 to module 20 or across a module 20, as explained in more detail below.

Figure 3:
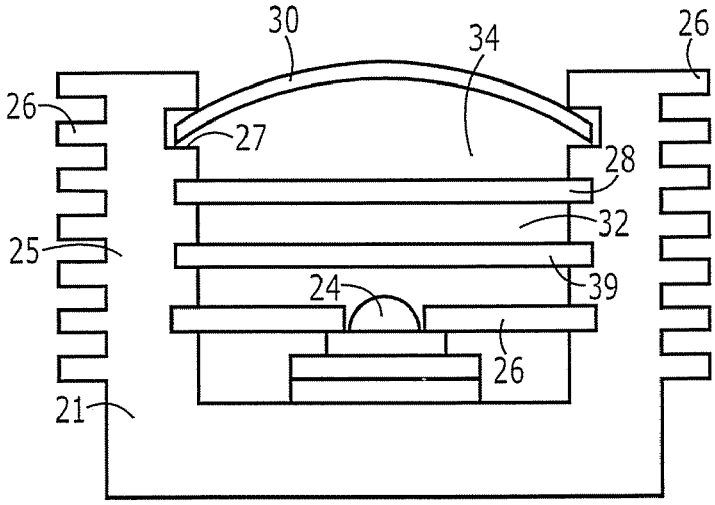
FIG. 3 is a cross sectional view of a linear illumination module according to further embodiments.

FIG. 3 is a cross sectional view of a linear illumination module 20 according to further embodiments. Referring to FIG. 3, the support member 21 may have one or more grooves or fins 31 on the outer sides of the sidewalls 25 and extending away from the sidewalls 25. The fins 31 can act as heat spreaders/radiators and/or can be provided to reduce the weight of the support member 21. The support member 21 may additionally have grooves/fins on the inside walls of the sidewalls 25 to act as heat spreaders/radiators and/or to reduce the weight of the support member 21. The support member 21 may additionally include grooves 27 on the inside walls of the sidewalls 25 that can provide mounting grooves for one or more optional optical elements, as discussed in more detail below. The grooves or fins 31 can also increase the stiffness of the module 20 without significantly increasing the weight of the module 20.

As further illustrated in FIG. 3, the outer diffuser sheet 30 may have a convex shape so that it is bowed away from the U-shaped channel of the support member 21. Furthermore, an additional diffuser sheet 39 can be provided within the first cavity 32 between the BEF 28 and the reflective sheet 26 to provide additional mixing/integration of the light emitted by the LEDs 24.

Figure 4:
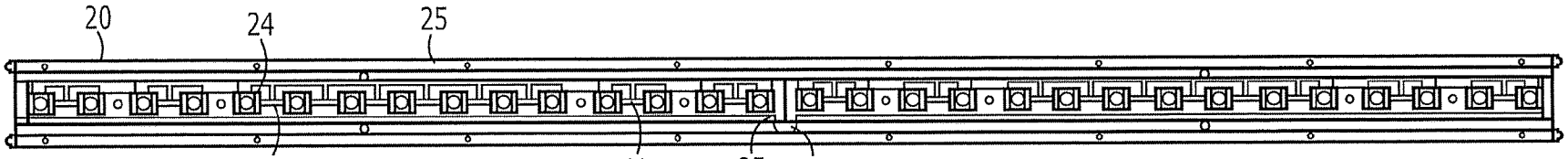
FIG. 4 is a plan view of a partially assembled linear illumination module according to some embodiments.

FIG. 4 is a plan view of a linear illumination module 20 without the BEF 28 or the diffuser sheet 30. A plurality of PCBs 22 are illustrated within the channel of a support member 21. Electrical connections 41 between adjacent LEDs 24 on a PCB 22 are illustrated, as are female electrical connectors 35 and wire jumpers 33.

Figure 5:
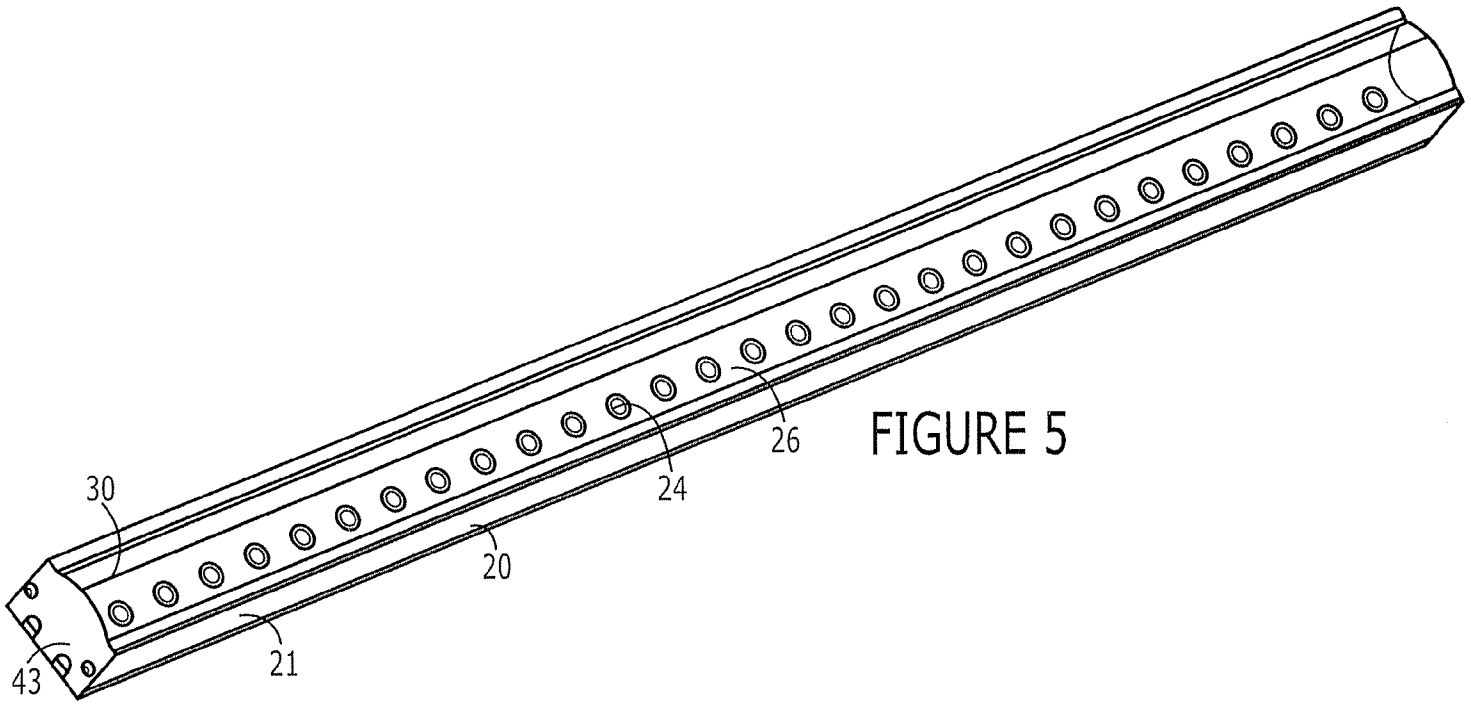
FIG. 5 is a perspective view of a linear illumination module including a convex diffuser sheet according to some embodiments.

FIG. 5 is a perspective view of a linear illumination module 20 including a convex diffuser sheet 30. A convex diffuser sheet 30 may encourage better spreading and/or more efficient extraction of light emitted by the module 20 compared to embodiments employing a flat diffuser sheet 30. The linear illumination module 20 includes end plates 43 that are affixed to respective ends of the support member 21. The inner walls of the end plate 43 may be painted/coated white and/or covered with a reflective layer of material such as MCPET.

Figure 6:
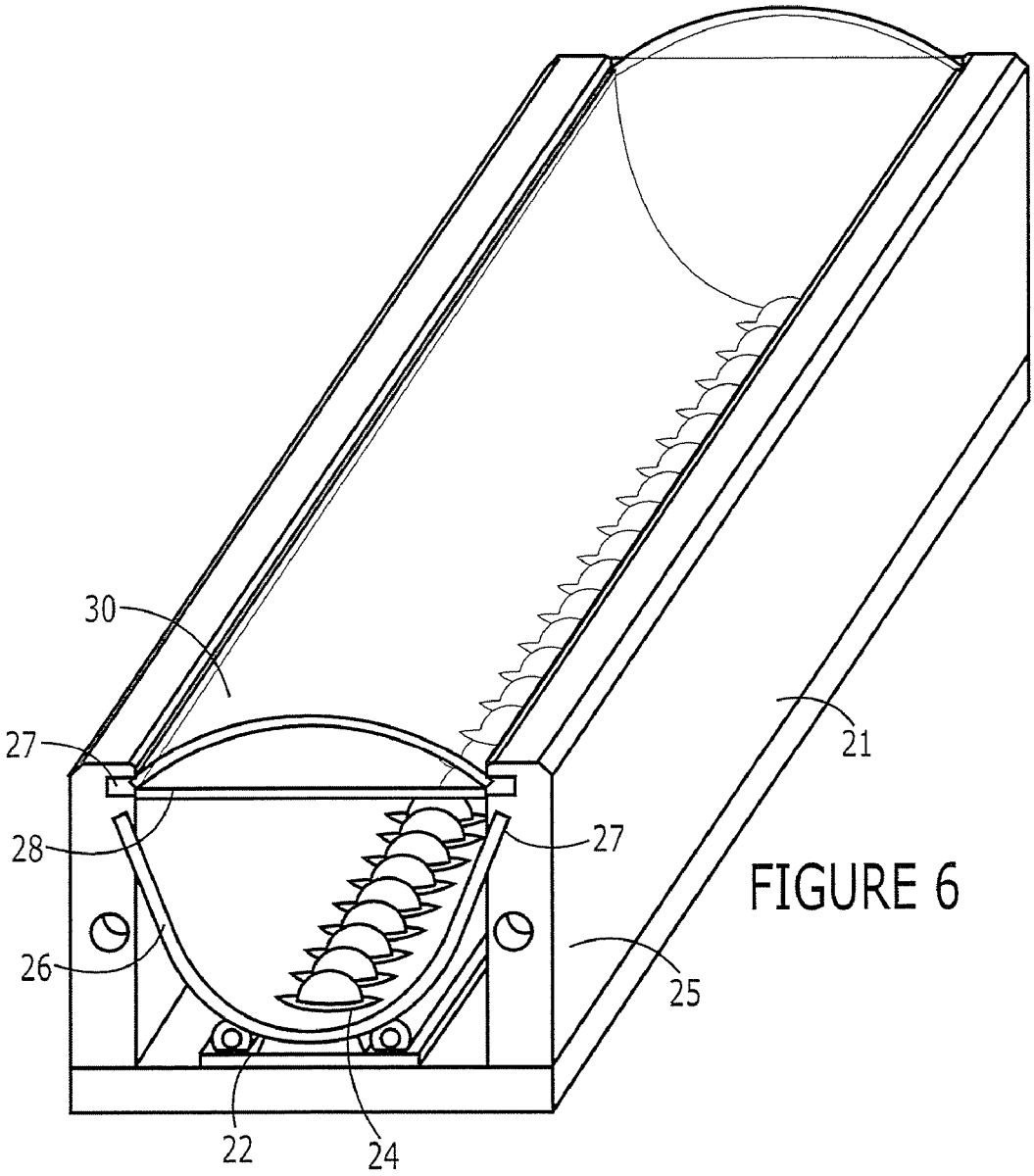
FIG. 6 is a perspective cutaway view of a linear illumination module according to some embodiments.

FIG. 6 is a perspective cutaway view of a linear illumination module 20 according to some embodiments. As shown therein, the linear illumination module 20 includes a concave reflector sheet 26 that is held in place by a pair of angled grooves 27 in the sidewalls 25 of the support member 21. As further illustrated in FIG. 6, the BEF 28 and the convex diffuser sheet 30 are held in place by a single pair of grooves 27 in the sidewalls 25 of the support member 21.

As noted above, the reflective sheet 26 may additionally or alternatively be bent or bowed in a parabolic, circular, hyperbolic, V-shape, U-shape or other form factor.

Figure 7:
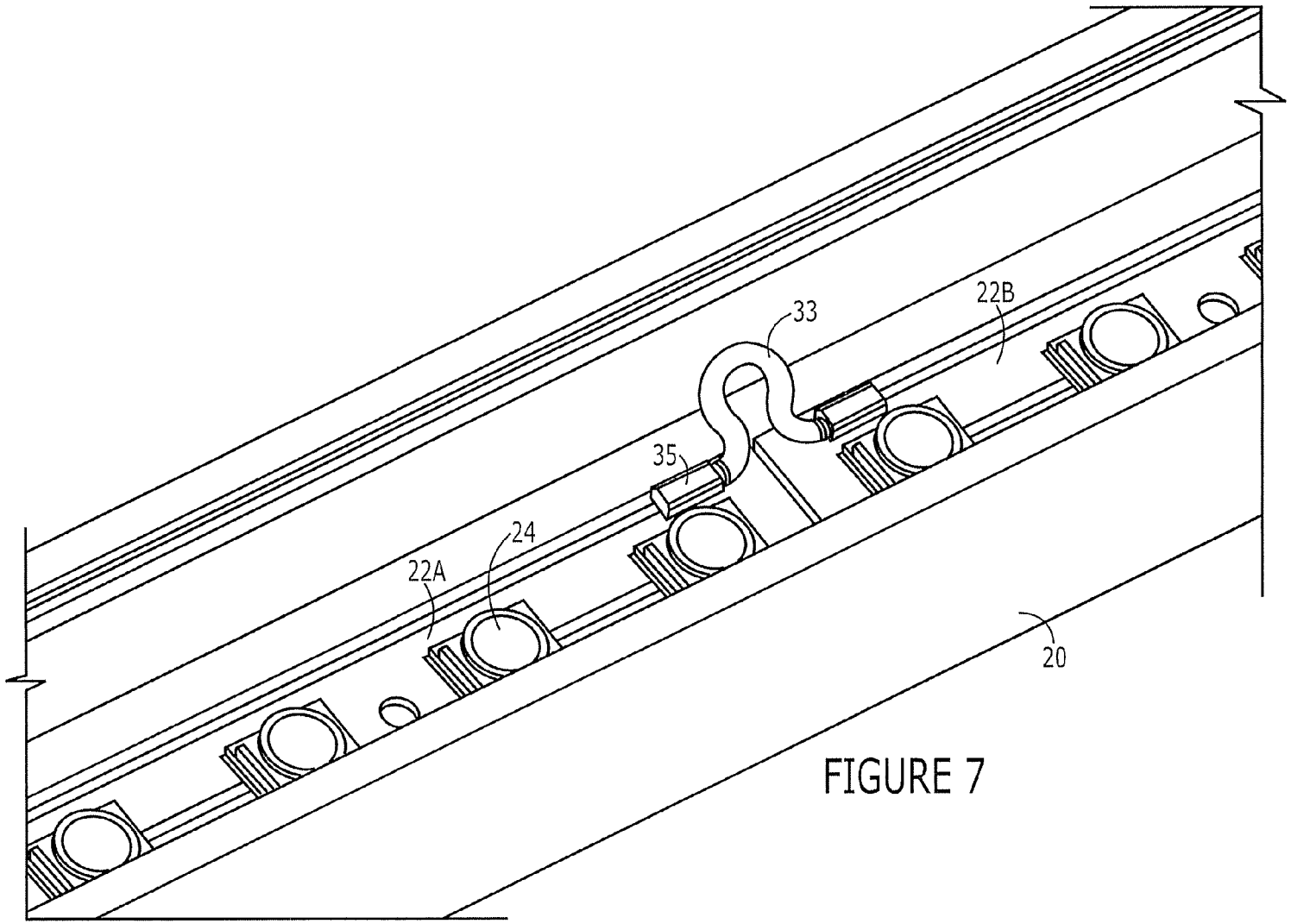
FIG. 7 is a perspective view of two printed circuit boards positioned adjacent one another on a support member.

Referring to FIG. 7, which is a perspective detail view of an illumination module 20 showing two PCBs 22A, 22B positioned adjacent one another on a support member 21, low-cost, low-profile SMT female connector headers 35 with two or more terminals may be placed at adjacent ends of the PCBs 22A, 22B to provide an interconnect means. Flexed wire jumpers 33 may be used to selectively connect adjacent PCBs 22A, 22B through the connector headers 35, to thereby provide a series connection of one PCB 22A, 22B to the other. The headers 35 may be side entry type, and the wire jumpers 33 may be inserted parallel to the PCBs 22A, 22B to reduce loop height. Parallel jumpers can also resist loosening due to the effects of gravity when the module is mounted parallel to a ceiling, for example. Flexion in the wire jumpers 33 biases the wire jumpers 33 into the connector headers 35, which can help the connection resist the effects of vibration, shock and gravity (which might otherwise cause connectors to back off and release), and/or repeated thermal expansion/contraction. Multiple jumpers 33 may be provided between adjacent PCBs 22A, 22B. The multiple jumpers can provide additional and/or redundant conductive paths between the PCBs 22A, 22B.

In some embodiments, the jumpers 33 may include white insulated wire jumpers 33 for interconnects to reduce any impact they might have on color/brightness uniformity. Similarly, the PCB 22 may be configured with white solder mask and the support member 21 may be painted or coated white, all or in part, such as by powder coating.

Figure 8:
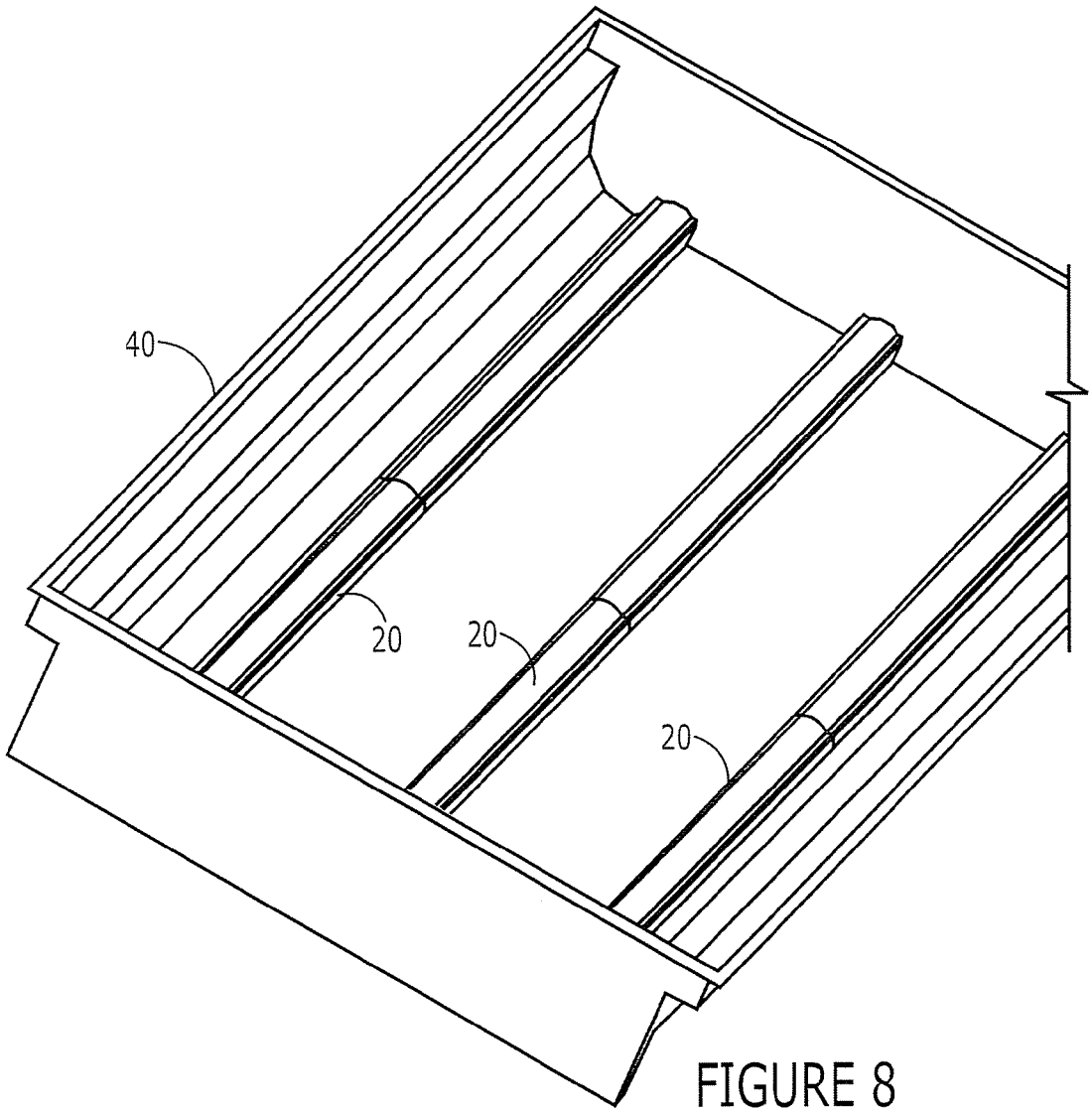
FIG. 8 is a perspective view illustrating a plurality of linear illumination modules mounted in a fixture.
Figure 9:
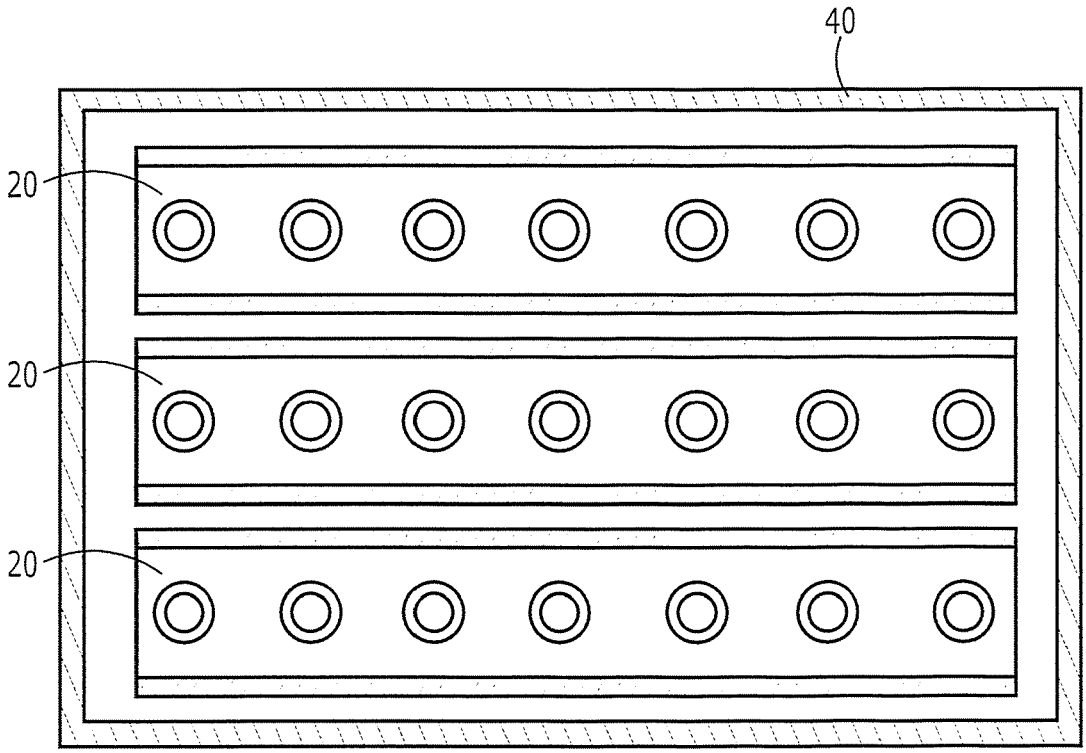
FIG. 9 is a plan view illustrating a plurality of linear illumination modules mounted in a fixture.

Referring to FIGS. 8 and 9, one or more modules 20, such as three for example, may be disposed within and on a sheet metal troffer 40 or other fixture, such as a standard fluorescent tube lamp fixture. A troffer is a ceiling recess shaped like an inverted trough with its bottom positioned next to the ceiling. Troffers are conventionally used, for example, to enclose fluorescent lamps. The modules 20 may be arranged parallel to one another as illustrated in FIGS. 8 and 9, or may be arranged in other configurations.

In an alternative form, the SMT LEDs 24 may be LED chips mounted to the PCB 22 by eutectic bonding, conductive epoxy, reflow paste solder or adhesive. In some embodiments, these LED chips may be pre-coated with a phosphor material and pre-sorted according to color and/or luminosity. In some embodiments, the SMT LEDs 24 or LED chips may be all of a white color emitting type. In some embodiments, some of the LEDs 24 may be of a saturated color emitting type. In some embodiments, some of the LEDs 24 may be white emitting and others may be of a saturated color emitting type. In some embodiments, some of the LEDs 24 may be cool light emitting and others may be green or red or warm white emitting. In some embodiments, there may be cool white, green white and warm white LEDs 24 on a single PCB 22. In some embodiments, there may be red, green and blue LEDs 24 on a PCB 22.

In some embodiments, there may be magenta emitting phosphor enhanced LEDs 24 and green and white or green LEDs 24 on a PCB 22. A magenta emitting phosphor enhanced LED can include, for example, a blue LED coated with a red phosphor, or with a red phosphor and a yellow phosphor. The magenta light emitted by a blue LED coated with red phosphor can combine, for example, with green light emitted by a green LED to produce white light. Such a combination can be particularly useful, as InGaN-based green LEDs can have relatively high efficiency. Furthermore, the human eye is most sensitive to light in the green portion of the spectrum. Thus, although some efficiency can be lost due to the use of a red phosphor, the overall efficiency of the pair of LEDs can increase due to the increased efficiency of a green LED.

The use of magenta LEDs in combination with green LEDs to produce white light can have surprising benefits. For example, systems using such LED combinations can have improved thermal-optical stability. In contrast, systems that include InGaN-based blue LEDs and AlInGaP-based red LEDs can have problems with thermal-optical stability, since the color of light emitted by AlInGaP-based LEDs can change more rapidly with temperature than the color of light emitted by InGaN-based LEDs. Thus, LED-based lighting assemblies that include InGaN-based blue LEDs and AlInGaP-based red LEDs are often provided with active compensation circuits that change the ratio of red to blue light emitted by the assembly as the operating temperature of the assembly changes, in an attempt to provide a stable color point over a range of temperatures.

In contrast, an assembly combining blue LEDs combined with red phosphor and green LEDs can have better thermal stability, possibly without requiring color compensation, because both the blue LEDs and the green LEDs can be InGaN-based devices that have similar responses to temperature variation.

In some embodiments, the module 20 may include LED/phosphor combinations as described in U.S. Pat. No. 7,213,940, issued May 8, 2007, and entitled "Lighting device and lighting method," the disclosure of which is incorporated herein by reference.

In some embodiments, brighter and dimmer LEDs 24 may be alternated in the linear array. For embodiments of some types, the LEDs 24 may be wired in two or more groups with independent current control or duty cycle control. The result will generally be a uniform high-efficiency linear light emitting diode illumination module 20.

As discussed previously, one of the significant challenges with mass production of illumination assemblies in which multiple LEDs 24 are employed is potential nonuniformity of color and/or luminosity arising from variations in the chromaticity and intensity/flux of the LED devices employed, and/or variations in the fluorescent media used for color conversion, if employed.

In order to contend with such non-uniformities, it is typical to 100% measure, sort and physically group (i.e. bin) the LED devices prior to their placement in a luminaire assembly or a multi-LED subassembly. However, this approach can present a serious logistics problem if the device-to-device variation in color and/or luminosity is large, as is often the case. In this case, the problem arising is that while physical sorting and grouping the devices into assembly may manage uniformity well for individual assemblies, there may still be in large differences from assembly to assembly. If multiple assemblies are used in an installation (such as multiple light fixtures in the ceiling of an office), the difference from assembly to assembly can become very obvious and objectionable. A common solution to this is for an assembly company making luminaires to purchase and utilize only a fraction of the LED device population after they are binned. In this fashion, all the fixtures made of by that company should come out appearing similar. But this poses yet another challenge, namely, what is to be done with all the other LED devices sorted and grouped but not purchased for making fixtures. Accordingly, some embodiments can address this problem, thereby potentially achieving simultaneously high uniformity within an assembly, high similarity from assembly to assembly, and/or elevated utilization of the production distribution of the LED devices.

Figure 10:
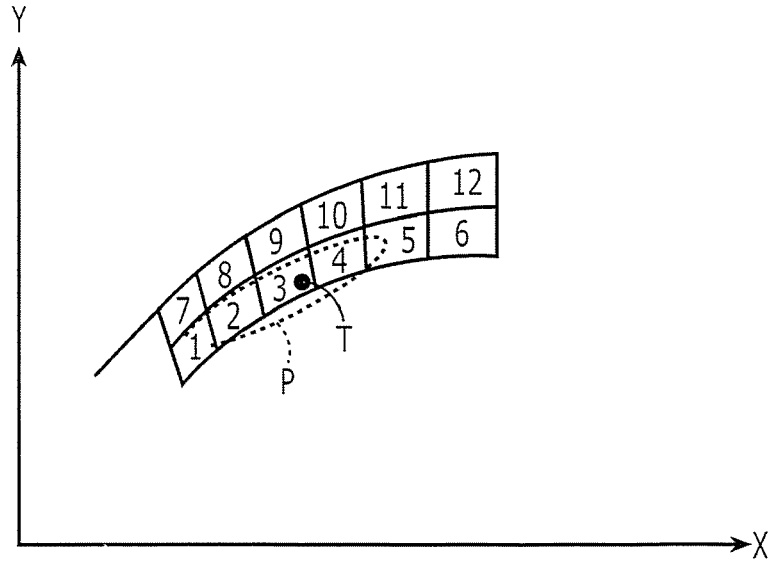
FIG. 10 illustrates a portion of a two-dimensional chromaticity space including bin locations and a production locus.

As an example, consider the binning system for white LEDs illustrated in FIG. 10, which is a portion of a 1931 CIE chromaticity diagram. As shown therein, a particular production system produces LEDs having a chromaticity falling within a production locus P. The locus P represents the variation boundaries in two-dimensional chromaticity space for the distribution of a production recipe, for example. The two-dimensional chromaticity space may, for example, be the 1931 CIE chromaticity space. The numbered polygons 1-12 illustrated in FIG. 10 are chromaticity bins. As each member of the LED production population is tested, the chromaticity of the LED is determined, and the LED is placed in an appropriate bin. Those members of the population having the same bin associations may be sorted and grouped together. It is common for a luminaire manufacturer to use members from one of these bins to make assemblies to assure uniformity within a multi-LED assembly and similarity between all such assemblies. However, much of the locus P would be left unused in such a situation.

Some embodiments provide enhanced mixing of light (by use of the recycling cavities 32, 34 bounded by reflective and other optical sheets, diffusers, BEFs, etc.) into which light from the LEDs 24 is injected. Some embodiments can also employ alternate binary additive color mixing to achieve metameric equivalent assemblies. "Binary additive color mixing" means the use of two light sources (e.g. LED devices) of known a different chromaticity within an optical homogenizing cavity to combine the two illuminations, such that a desired third apparent color is created. The third apparent color can result from a variety of alternate binary combinations that may all be the same in two-dimensional chromaticity space (i.e. metameric equivalents).

Referring still to FIG. 10, a production population chromaticity locus P is shown as at least partially covering five bin groups 1-5.

Figure 11:
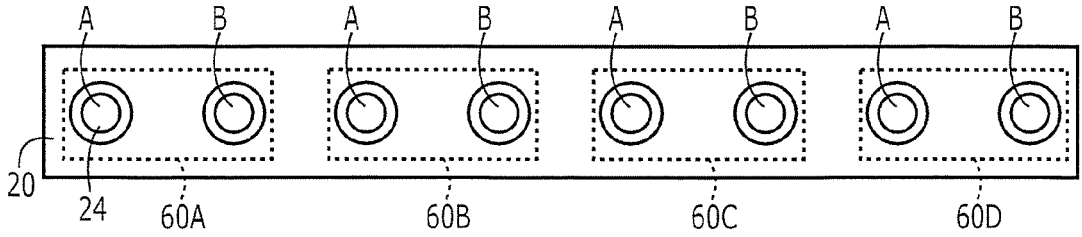
FIG. 11 illustrates placement of various type of LEDs on a linear illumination module according to some embodiments.

Referring to FIG. 11, a linear illumination module 20 is shown including a plurality of LED devices 24 for use in illumination assembly. The module 20 includes at least one homogenizing cavity 32, 34 (FIG. 1). As shown in FIG. 11, two alternating groups of LED devices are labeled a group A and group B. The LED devices 24 are grouped into groupings 60, referred to herein as metameric groupings 60A-60D. Chromaticities of the LEDs 24 of the metameric groupings 60A-60D are selected so that a combined light generated by a mixture of light from each of the LEDs 24 of the metameric groupings 60A-60D may include light having about a target chromaticity T. Two points in a two-dimensional chromaticity space are considered to have about the same chromaticity if one point is within a seven step Macadam ellipse of the other point, or vice versa. A Macadam ellipse is a closed region around a center point in a two-dimensional chromaticity space, such as the 1931 CIE chromaticity space, that encompasses all points that are visually indistinguishable from the center point. A seven-step Macadam ellipse captures points that are indistinguishable to an ordinary observer within seven standard deviations.

A two-dimensional chromaticity space may include a 1931 CIE chromaticity space or a 1976 CIE chromaticity space.

Figure 12:
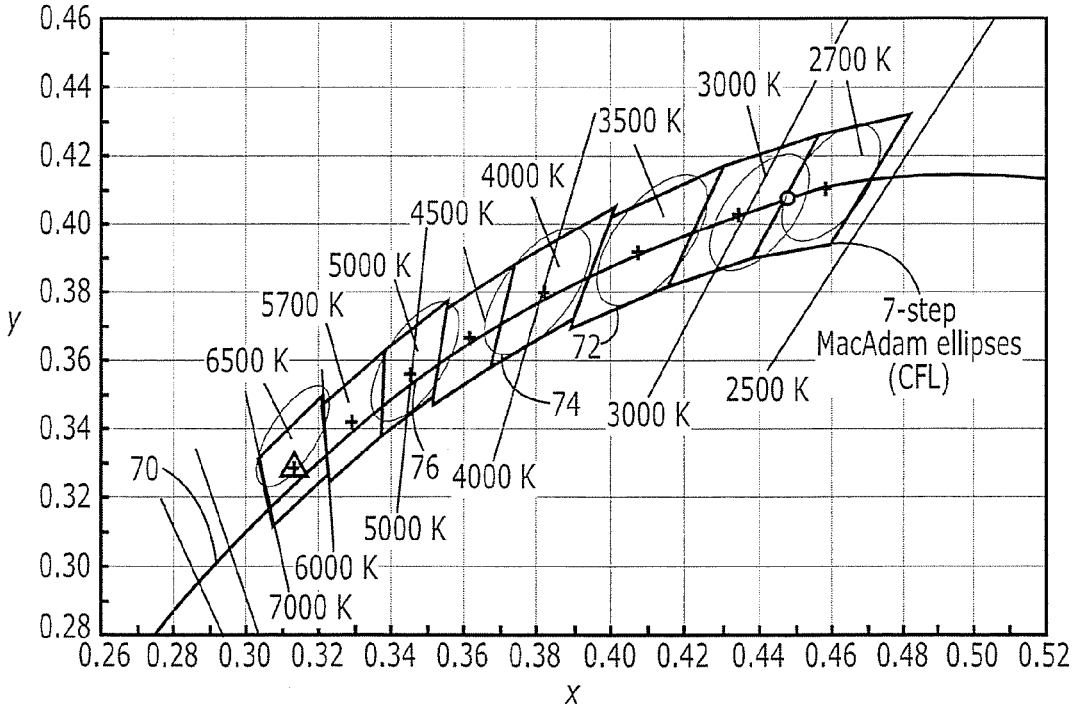
FIG. 12 illustrates a portion of a two-dimensional chromaticity space including the blackbody radiation curve and correlated color temperature (CCT) quadrangles of light generally considered white.

In some embodiments, the chromaticity of each of the LEDs 24 of a metameric groupings 60A-60D may be within about a seven step Macadam ellipse about a point on a blackbody radiation curve on a 1931 CIE chromaticity space from a correlated color temperature (CCT) of 2500K to 8000K. Thus, each of the LEDs 24 may individually have a chromaticity that is within a region that is generally considered to be white. For example, FIG. 12 illustrates a portion of a 1931 CIE diagram including the blackbody radiation curve 70 and a plurality of CCT quadrangles, or bins, 72. Furthermore, FIG. 12 illustrates a plurality of 7-step Macadam ellipses 74 around various points 76 on or near the blackbody radiation curve 70.

However, in some embodiments, one or more of the LEDs 24 of a metameric grouping 60A-60D may have a chromaticity that is outside a seven step Macadam ellipse about a point on a blackbody radiation curve on a 1931 CIE chromaticity space from a correlated color temperature of 2500K to 8000K, and thus may not be considered white to an observer.

Thus, to achieve a desired series of illuminator assemblies with such a linear module 20 with the series having substantially equal apparent chromaticity at the target point T, each assembly thus providing a metameric equivalent of chromaticity T, the following three alternate pairs of A/B binary additive combinations may be used:

A and B are from Bin three.

A and B are from Bins two and four, respectively.

A and B are from Bins one and five, respectively.

Accordingly, an adjacent pair of devices A and B in the module 20 may be selected based on their actual chromaticity points being about equidistant from the target chromaticity point T, or being in bins that are about equidistant from the bin in which the target chromaticity point T is located.

By considering the effects of luminosity in additive color mixing, some embodiments provide additional binary pairs effective to create the same metameric equivalent target T chromaticity assembly. A luminosity (luminous intensity, luminous flux, etc.) ranking system of three ascending ranges of luminosity can be defined, for example, as:

Af: 85 to 90 lumens

Bf: 90 to 95 lumens

Cf: 95 to 100 lumens

Then, additional allowable pairs for the previous example may include:

A and B are Bin two, Rank Cf, and Bin five Rank Af, respectively

A and B are Bin four, Rank Cf and Bin one, Rank Af, respectively

A and B are Bin three, Rank Af and Bin three, Rank Cf, respectively

Thus, each of the LEDs 24 of each metameric grouping 60A-60D may have a luminosity that is generally inversely proportional to a distance of a chromaticity of the LED 24 to the target chromaticity T in a two-dimensional chromaticity space.

Accordingly, an adjacent group of devices A and B in the module 20 may be selected to provide a desired light output. IN a binary system, for example, where a first device of the pair of devices is closer to the target chromaticity point T, the first device may have a higher brightness than the second device of the pair of devices. Likewise, where a first device of the pair of devices is farther form the target chromaticity point T, the first device may have a lower brightness than the second device of the pair of devices. Where the devices are in chromaticity bins that are about equidistant from the target chromaticity point, the devices may have about the same brightness. Thus, in some embodiments, each of the LEDs 24 of a metameric grouping 60A-60D may have about the same luminosity and may have a chromaticity that is about the same distance from the target chromaticity T in two dimensional chromaticity space.

By using an effective homogenizer, using alternate mixing to achieve equivalent metameric targets from a multitude of bin groupings and/or an alternating LED device layout of the linear module 20, it may be possible to utilize a large proportion of distribution locus P while still achieving a product distribution with good uniformity within each luminaire assembly and/or good similar similarity among a produced series of luminaire assemblies. The better the recycling homogenizing effect, the greater differences between devices that constitute a metameric grouping are allowable without impacting uniformity.

Although binary groupings are illustrated in FIG. 11, it will be appreciated that ternary, quaternary and higher-order versions may also be utilized, in which a metameric grouping includes three or more LED devices.

In the drawings and specification, there have been disclosed typical embodiments of the invention and, although specific terms are employed, they are used in a generic and descriptive sense only and not for purposes of limitation, the scope of the invention being set forth in the following claims.

What is claimed is:

1. An illumination module, comprising:

a longitudinal support member including a base portion and a pair of sidewalls extending from the base portion, the base portion and the pair of sidewalls defining a channel that extends in a longitudinal direction parallel to the sidewalls;

a printed circuit board (PCB) on the base portion of the support member and extending in the longitudinal direction within the channel;

a plurality of light emitting diodes (LEDs) mounted on the PCB and arranged in an array extending in the longitudinal direction;

a reflective sheet within the channel and extending across the channel between the pair of sidewalls, wherein the PCB is between the reflective sheet and the base portion of the support member, wherein the reflective sheet includes a plurality of holes therein that are arranged to correspond with locations of the LEDs on the PCB, and wherein the LEDs are at least partially positioned within the holes; and an optical film positioned in the channel and extending across the channel between the pair of sidewalls and defining an optical cavity between the reflective sheet and the optical film into which light is emitted by the LEDs, wherein the optical film, the reflective sheet and the sidewalls of the support member are configured to recycle light in the optical cavity by reflecting some light emitted by the LEDs back into the optical cavity and transmitting some light emitted by the LEDs out of the optical cavity wherein the plurality of LEDs comprises a pair of LEDs each having a chromaticity that is within about a seven step Macadam ellipse about a point on a blackbody radiation curve on a 1931 CIE chromaticity space from a correlated color temperature of 2500K to 8000K~ and wherein the pair of LEDs have different optical characteristics, wherein said pair of LEDs is a metameric pair and wherein chromaticities of the LEDs of the metameric pair are selected so that a combined light generated by a mixture of light from each of the LEDs of the metameric pair comprises light having about a target chromaticity.

2. The illumination module of claim 1, wherein the optical film comprises a first optical film and the optical cavity comprises a first optical cavity, the illumination module further comprising:

a second optical film on the support member and extending between the pair of sidewalls, the second optical film and the first optical film defining a second optical cavity wherein the first optical film, the second optical film and the sidewalls of the support member are configured to recycle light in the second optical cavity.

3. The illumination module of claim 2, wherein the first optical film comprises a brightness enhancement film and the second optical film comprises an optical diffuser.

4. The illumination module of claim 2, wherein the reflective sheet comprises a diffuse reflector.

5. The illumination module of claim 2, further comprising:

a third optical film positioned in the first optical cavity between the first optical film and the reflective sheet and extending across the channel between the pair of sidewalls.

6. The illumination module of claim 5, wherein the third optical film comprises an optical diffuser.

7. The illumination module of claim 1, wherein the sidewalls comprise a pair of longitudinally extending grooves within the channel, wherein the optical film is engaged and supported within the channel by the grooves.

8. The illumination module of claim 1, wherein the sidewalls comprise a plurality of outwardly extending fins on outer surfaces of the sidewalls.

9. The illumination module of claim 1, wherein the optical film comprises a convex diffuser sheet that is bowed away from the channel in a lateral direction that is perpendicular to the longitudinal direction and that is not bowed in the longitudinal direction.

10. The illumination module of claim 1, wherein the reflective sheet has a curved cross section in a lateral direction that is perpendicular to the longitudinal direction and wherein the sidewalls comprise a pair of longitudinal grooves therein that engage edges of the reflective sheet.

11. The illumination module of claim 1, wherein the PCB comprises a first PCB, the illumination module further comprising:

a second PCB on the base portion of the support member and extending in the longitudinal direction within the channel, wherein the second PCB is adjacent to the first PCB in the longitudinal direction, wherein the first PCB and the second PCB each comprise an electrical connector at respective adjacent ends thereof; and a wire jumper connecting the electrical connectors.

12. The illumination module of claim 1, wherein each of the LEDs of the metameric pair has a luminosity that is inversely proportional to a distance of a chromaticity of the LED to the target chromaticity in a two-dimensional chromaticity space.

13. The illumination module of claim 12, wherein each of the LEDs has about the same luminosity and has a chromaticity that is about the same distance from the target chromaticity in the two-dimensional chromaticity space.

14. The illumination module of claim 12, wherein the two-dimensional chromaticity space comprises a 1931 CIE chromaticity space or a 1976 CIE chromaticity space.

* * * * *